US008970433B2

(12) United States Patent
Kenoun et al.

(10) Patent No.: US 8,970,433 B2
(45) Date of Patent: Mar. 3, 2015

(54) ANTENNA ASSEMBLY THAT IS OPERABLE IN MULTIPLE FREQUENCIES FOR A COMPUTING DEVICE

(75) Inventors: Robert Kenoun, San Jose, CA (US); Joselito dela Cruz Gavilan, San Jose, CA (US)

(73) Assignee: QUALCOMM Incorporated, San Diego, CA (US)

( * ) Notice: Subject to any disclaimer, the term of this patent is extended or adjusted under 35 U.S.C. 154(b) by 211 days.

(21) Appl. No.: 13/306,128

(22) Filed: Nov. 29, 2011

(65) Prior Publication Data

US 2013/0135150 A1 May 30, 2013

(51) Int. Cl.

| | |
|---|---|
| ***H01Q 1/38*** | (2006.01) |
| ***H01Q 5/00*** | (2006.01) |
| ***H01Q 9/04*** | (2006.01) |
| ***H01Q 1/48*** | (2006.01) |
| ***H01Q 9/42*** | (2006.01) |

(52) U.S. Cl.
CPC ..... *H01Q 9/42* (2013.01)
USPC ..... 343/700 MS; 343/846

(58) Field of Classification Search
CPC ..... H01Q 9/42; H01Q 9/26; H01Q 23/00; H01Q 9/0421; H01Q 9/0442; H01Q 5/00; H01Q 5/0034
USPC ..... 343/700 MS, 702, 876
See application file for complete search history.

(56) References Cited

U.S. PATENT DOCUMENTS

| | | | | |
|---|---|---|---|---|
| 6,903,693 | B1 | 6/2005 | Lee et al. | |
| 8,013,796 | B2 | 9/2011 | Liu et al. | |
| 2004/0233109 | A1 * | 11/2004 | Ying et al. | 343/700 MS |
| 2005/0168384 | A1 * | 8/2005 | Wang et al. | 343/700 MS |
| 2006/0152419 | A1 * | 7/2006 | Sato et al. | 343/702 |
| 2007/0241970 | A1 * | 10/2007 | Thornell-Pers | 343/702 |
| 2007/0247373 | A1 * | 10/2007 | Egorov | 343/702 |
| 2009/0219215 | A1 | 9/2009 | Huber et al. | |
| 2010/0053007 | A1 * | 3/2010 | Ni et al. | 343/745 |
| 2011/0001669 | A1 | 1/2011 | Wang et al. | |
| 2011/0133992 | A1 | 6/2011 | Suzuki | |
| 2013/0099996 | A1 * | 4/2013 | Tseng et al. | 343/876 |

FOREIGN PATENT DOCUMENTS

| | | | | |
|---|---|---|---|---|
| CN | 201118646 Y | | 9/2008 | |
| JP | 2006238269 A | * | 9/2006 | 343/702 |
| JP | 2011018999 A | | 1/2011 | |
| JP | 2001077608 A | | 4/2011 | |

* cited by examiner

*Primary Examiner* — Dameon E Levi
*Assistant Examiner* — Ricardo Magallanes
(74) *Attorney, Agent, or Firm* — Mahamedi Paradice LLP

(57) ABSTRACT

An antenna assembly for a computing device is disclosed. The antenna assembly includes a first radiating element coupled to a feed point and a first ground point of a printed circuit board, and a second radiating element coupled to a second ground point of the printed circuit board. The first radiating element is positioned adjacent to the printed circuit board so as to form a first gap that extends between the first radiating element and the printed circuit board along at least a portion of the length of the first radiating element. The second radiating element is positioned adjacent to the printed circuit board so as to form a second gap that extends between the second radiating element and the printed circuit board along at least a portion of the length of the second radiating element. The two radiating elements are spaced apart by a third gap.

20 Claims, 9 Drawing Sheets

ANTENNA ASSEMBLY THAT IS OPERABLE IN MULTIPLE FREQUENCIES FOR A COMPUTING DEVICE

BACKGROUND

Antenna designs for computing devices vary depending on the requirements for mobile communication standards as well as structural designs of the computing devices themselves. Typical challenges for designing antennas include designing antennas that cover new frequency bands (e.g., such as 4G frequency bands) and carrier requirements (e.g., a 2×2 MIMO antenna scheme requirement, or data rate requirements), designing antennas that meet sizing limitations and spacing within the housing of a computing device (e.g., the limitations of antenna layout space), and integrating antennas with internal components with minimal tradeoff of layout space on a printed circuit board.

BRIEF DESCRIPTION OF THE DRAWINGS

The disclosure herein is illustrated by way of example, and not by way of limitation, in the figures of the accompanying drawings and in which like reference numerals refer to similar elements, and in which.

DETAILED DESCRIPTION

Figure 1A:
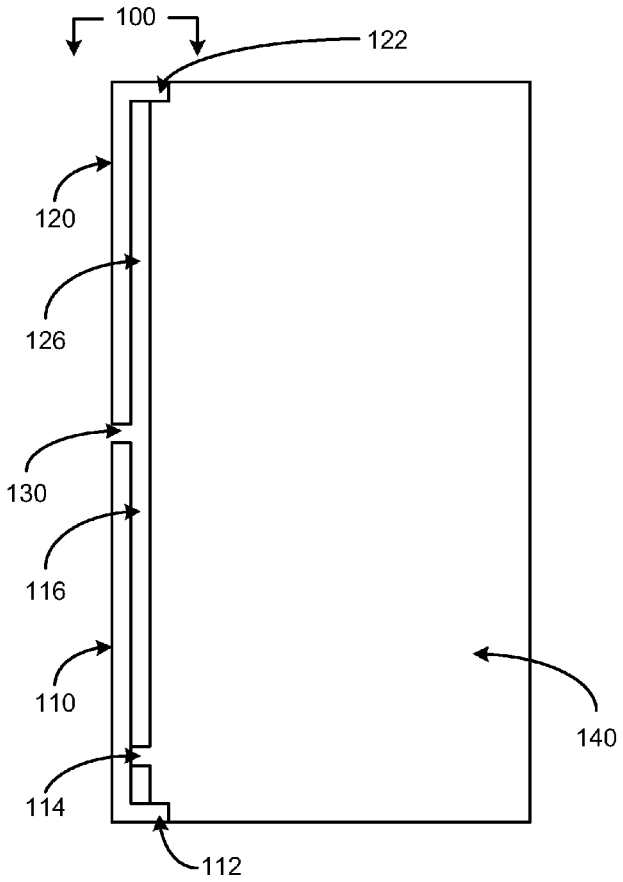
FIG. 1A illustrates an example antenna assembly for a computing device, according to an embodiment.

Embodiments described herein include an antenna assembly for a computing device. By using different structural dimensions of radiating elements and by varying gap sizes between the radiating elements, embodiments enable the antenna assembly to operate in multiple frequencies. According to some embodiments, the antenna assembly enables a computing device to perform wireless (e.g., mobile) communications that satisfy various communication standards (e.g., 4G, LTE, standards set by mobile carriers). In some embodiments, the antenna assembly expands the bandwidths of the frequency bands and satisfies multiple frequency bandwidth requirements and multiple-input and multiple-output (MIMO) data rate requirements, while concurrently meeting size/space requirements of a computing device without significant loss to antenna performance. Among other benefits, the antenna assembly allows for the antenna to be configured in order to satisfy frequency requirements by changing the geometry (e.g., size, width, length) of various antenna components. In other embodiments, the configuration of the antenna assembly can improve its diversity aspect.

In one embodiment, the antenna assembly includes two radiating elements. A radiating element is an antenna component that is used to convert electrical currents into radio waves, and vice versa, and is coupled to a receiver and/or a transmitter. It may be composed of a conductive material. A first radiating element is coupled to a feed point and a first ground point of a PCB, and a second radiating element is coupled to a second ground point of the PCB. In some embodiments, the second radiating element is a parasitic or passive radiating element that is not connected to a feed point. The first radiating element is positioned adjacent to the PCB so as to form a first gap that extends between the first radiating element and the printed circuit board along at least a portion of a length of the first radiating element. The second radiating element is also positioned adjacent to the PCB so as to form a second gap that extends between the second radiating element and the PCB along at least a portion of a length of the second radiating element. The first radiating element and the second radiating element are also spaced apart by a third gap.

According to an embodiment, the geometry of the radiating elements of the antenna assembly may be dimensioned to enable the radiating elements to resonate at particular frequencies. The geometry of the radiating elements includes at least a width, length, or thickness of the radiating elements. The radiating elements and the width of the gaps may be dimensioned to enable the first radiating element and the second radiating element to each resonate at a low band frequency (e.g., the first radiating element resonates at a first predetermined low band frequency and the second radiating element resonates at a second predetermined low band frequency that is substantially the same frequency as the first predetermined low band frequency). In some embodiments, the first and second radiating elements may be substantially equal in length (and/or width and/or thickness).

In some embodiments, the antenna assembly can include a third radiating element that is coupled to the feed point and the first ground point of the PCB. The third radiating element can be dimensioned to resonate at a first predetermined high band frequency. The first predetermined high band frequency can be a higher frequency than the first and second predetermined low band frequencies. According to an embodiment, depending on the dimensions of the first, the second and the third radiating elements, the first and second radiating elements may each resonate at a lower frequency band than the third radiating element.

According to another embodiment, an antenna assembly comprises a first radiating element with a first end that is coupled to a feed point and a first ground point of a PCB. The first radiating element also has a second end that is coupled to a first circuit that is provided by or on the PCB. The antenna assembly also includes a second radiating element that has a first end that is coupled to the first circuit. The first radiating element and the second radiating element are spaced apart by a first gap, and are both positioned adjacent to the PCB. The first circuit operates to enable the antenna assembly to resonate in both a high band frequency and a low band frequency. In some embodiments, the first circuit is a resonant/anti-resonant circuit that is resonant at a certain frequency band and anti-resonant at another frequency band.

The antenna assembly also includes a third radiating element that is coupled to a second ground point of the PCB. The third radiating element is positioned adjacent to the printed circuit board. According to an embodiment, the third radiating element is a parasitic or passive radiating element that is not connected to a feed point. In one embodiment, the third radiating element has a length that is substantially equal to the combination of (i) the length of the first radiating element, (ii) the length of the second radiating element, and (iii) the width of the first gap. The third radiating element and the second radiating element are spaced apart by a second gap.

In one embodiment, the first circuit is configured to be resonant at high band frequencies and anti-resonant at low band frequencies. When the first circuit is resonant, it behaves similarly to an open switch, which allows the first radiating element to resonate at the first predetermined high band frequency. When the first circuit is anti-resonant, it behaves similarly to a closed switch, thereby connecting the first and second radiating elements to behave as one radiating structure. The first and second radiating elements resonates together at the first predetermined low band frequency. When the first radiating element and the second radiating element resonate together at the first predetermined low band frequency, the third radiating element, which behaves as a parasitic radiating element, can resonate at a second predetermined low band frequency. The second predetermined low band frequency is substantially the same frequency as the first predetermined low band frequency (e.g., side-by-side frequencies).

In another embodiment, the antenna assembly also includes a second circuit that is coupled to a second end of the second radiating element. The second circuit is also coupled to a third ground point of the PCB. The second circuit may operate in conjunction from the first circuit. In some embodiments, the second circuit may also be a resonant/anti-resonant circuit that is resonant at a certain frequency band and anti-resonant at another frequency band, or may be a two state switch (e.g., open and closed states). As discussed, in one embodiment, the first circuit is configured to be resonant at high band frequencies and anti-resonant at low band frequencies. At high band frequencies, the first circuit is resonant so that the first radiating element resonates at the first predetermined high band frequency. In addition, at the high band frequencies, the second circuit can be anti-resonant (or behave in a closed state if the second circuit is a two state switch) so that the second end of the second radiating element is coupled to the third ground point of the PCB. This causes the second radiating element to behave as a parasitic radiating element (when the first radiating element resonates at the first predetermined high band frequency) and the second radiating element resonates at a second predetermined high band frequency. The second predetermined high band frequency is substantially the same frequency as the first predetermined high band frequency (e.g., side-by-side frequencies).

According to an embodiment, when the antenna assembly includes the first and second circuits, at low band frequencies, the first circuit is anti-resonant so that the first radiating element and the second radiating element resonate together (e.g., as one radiating structure) at the first predetermined low band frequency. In addition, the second circuit can be resonant in low band frequencies (or behave in an open state if the second circuit is a two state switch) so that the second end of the second radiating element is not coupled to the third ground point of the PCB. As the first radiating element and the second radiating element resonate together at the first predetermined low band frequency, the third radiating element behaves as a parasitic radiating element and resonates at a second predetermined low band frequency. The second predetermined low band frequency is substantially the same frequency as the first predetermined low band frequency. The parasitic or passive radiating elements may be used to enhance and improve the frequency bandwidths of the antenna assembly.

According to various embodiments, the geometry of the radiating elements includes at least a width, length, or thickness. The geometry of the radiating elements and the width of the gaps (e.g., the gap between the first and second radiating elements, and the gap between the second and third radiating elements) may be dimensioned to enable the first radiating element to resonate at a first predetermined high band frequency, to enable the combination of the first and second radiating elements to resonate at a first predetermined low band frequency, and to enable the third radiating element to resonate at a second predetermined low band frequency (depending on the configuration of the antenna assembly). In some embodiments, the first and second radiating elements may be substantially equal in length (and/or width and/or thickness).

In other embodiments, a computing device may comprise two (or more) antenna assemblies. A first antenna assembly may be positioned along one side of the PCB, while a second antenna assembly may be positioned along the other side of the PCB. In some embodiments, both antenna assemblies may be dimensioned to be symmetric, or may be asymmetric so that the antenna assemblies are different in structure or size.

One or more embodiments described herein provide that methods, techniques and actions performed by a computing device are performed programmatically, or as a computer-implemented method. Programmatically, as used herein, means through the use of code, or computer-executable instructions. A programmatically performed step may or may not be automatic. With regard to some quantitative expressions used herein, the expression "substantial" or "substantially" means 90% or more of a stated quantity or comparison. Furthermore, the term "majority" means at least 50% more than 50% of a stated quantity or comparison.

One or more embodiments described herein may be implemented using programmatic modules or components. A programmatic module or component may include a program, a sub-routine, a portion of a program, or a software component or a hardware component capable of performing one or more stated tasks or functions. As used herein, a module or component can exist on a hardware component independently of other modules or components. Alternatively, a module or component can be a shared element or process of other modules, programs or machines.

Some embodiments described herein may generally require the use of computers, including processing and memory resources. For example, one or more embodiments described herein may be implemented, in whole or in part, on computing machines such as desktop computers, cellular phones, laptop computers, printers, digital picture frames, and tablet devices. Memory, processing and network resources may all be used in connection with the establishment, use or performance of any embodiment described herein (including with the performance of any method or with the implementation of any system).

Furthermore, one or more embodiments described herein may be implemented through the use of instructions that are executable by one or more processors. These instructions may be carried on a computer-readable medium. Machines shown or described with figures below provide examples of processing resources and computer-readable mediums on which instructions for implementing embodiments of the invention can be carried and/or executed. In particular, the numerous machines shown with embodiments of the invention include processor(s) and various forms of memory for holding data and instructions. Examples of computer-readable mediums include permanent memory storage devices, such as hard drives on personal computers or servers. Other examples of computer storage mediums include portable storage units, such as CD or DVD units, flash memory (such as carried on many cell phones and PDAs), and magnetic memory. Computers, terminals, network enabled devices (e.g., mobile devices such as cell phones) are all examples of machines and devices that utilize processors, memory, and instructions stored on computer-readable mediums. Additionally, embodiments may be implemented in the form of computer-programs, or a computer usable carrier medium capable of carrying such a program.

Antenna Assemblies

FIG. 1A illustrates an example antenna assembly for a computing device, according to an embodiment. The antenna assemblies described with respect to all the figures may be implemented on, for example, a mobile computing device or small-form factor device, or other computing form factors such as a tablet, notebook, or desktop computer. According to FIG. 1A, the antenna assembly 100 includes a first radiating element 110 and a second radiating element 120. The first radiating element 110 is coupled to a first ground point 112 of the printed circuit board ("PCB") 140 and a feed point 114. The second radiating element 120 is coupled to a second ground point 122 of the PCB 140.

A feed point refers a component(s) which feed radio waves to a radiating element, or receives incoming radio waves from a radiating element and converts them to electrical currents to transmit them to a receiver. The feed point 114 enables the first radiating element 110 to be coupled to a signal source (that is provided on or as part of the PCB 140) and in some embodiments, to other components (e.g., transceiver circuits, radio processing circuitry, processors) of a computing device. A ground point refers to a reference point from which other voltages are measured or refers to a common return path for an electrical current.

In some embodiments, the second radiating element 120 may behave a parasitic or passive radiating element that will resonate at a frequency due to the first radiating element 110 resonating at a particular frequency (where the first radiating element 110 resonates in response to receiving a signal from the feed point 114). The parasitic or passive radiating element may be used to expand the bandwidth of frequencies.

According to an embodiment, the first radiating element 110 is positioned adjacent to the PCB 140 so as to form a first gap 116 that extends between the first radiating element 110 and the PCB 140 along at least a portion of the length of the first radiating element 110. Similarly, the second radiating element 120 is positioned adjacent to the PCB 140 so as to form a second gap 126 that extends between the second radiating element 120 and the PCB 140 along at least a portion of the length of the second radiating element 120. The first radiating element 110 and the second radiating element 120 is also separated or spaced apart from each other by a third gap 130. The geometry (e.g., the length, the width, the thickness) of the first radiating element 110 and the second radiating element 120 may be dimensioned so that the first radiating element 110 and the second radiating element 120 are tuned to resonate at a particular frequency or frequency bands. The third gap 130 may be tuned or dimensioned to cause the second radiating element 120 to resonate (as a parasitic radiating element) when the first radiating element 110 resonates due to receiving a signal via the feed point 114.

For example, depending on the geometries of the first and second radiating elements 110, 120, the first radiating element 110 may be tuned to resonate at a low frequency band (e.g., between 700-1000 MHz). By changing the length (e.g., elongating or shortening) of the first radiating element 110, for example, the first radiating element 110 may be configured to resonate at different frequencies. Because the first radiating element 110 is coupled to the first ground point 112 and the feed point 114, the first radiating element 110 may resonate at a low frequency band. The second radiating element 120 may also resonate at a low frequency (due to the first radiating element 110 resonating at a low frequency) that is substantially the same frequency as the resonating frequency of the first radiating element 110 (e.g., the second radiating element 120 may resonate at a frequency that is 10 to 150 MHz different than the resonating frequency of the first radiating element 110, etc.). As both radiating elements 110, 120 resonate, the frequency bandwidth of the antenna assembly 100 may be improved.

The antenna assembly 100 can be configured and dimensioned so that a manufacturer of the mobile computing device may have the flexibility to enable the antenna assembly 100 to operate at certain frequencies (e.g., tune to the desired frequencies by changing the geometries of the radiating elements and the gaps). The two radiating elements 110, 120 may also be tuned independently by sizing the dimensions individually. In some embodiments, the two radiating elements 110, 120 may be symmetric in size. At the same time, the antenna assembly 110 may be dimensioned to also meet size constraints due to the layout of the electrical components on the PCB and due to the design of the housing of the mobile computing device. The length of the PCB 140 may be between 100 mm and 150 mm (depending on the housing of the computing device), such as between 120 mm and 135 mm.

Another additional benefit includes helping meet SAR and HAC requirements because the active portion of radiating elements may be positioned near the lower half of a computing device. In addition, two antenna assemblies alongside each of the PCB for a computing device (such as seen in FIG. 1C) have a maximum gain at two opposing directions, which makes them a perfect pair as LTE or diversity antennas, with correlation coefficients at very low numbers. These two antenna assemblies also have a very small gain imbalance because they are substantially equal in their performance. Typically, the diversity antennas are by far poorer performers than the main antenna, which results in a larger gain imbalance. Similar benefits may be seen in the antenna assemblies described in FIGS. 2-4D.

In other embodiments, the antenna assembly 100 may include a first radiating element 110 and/or a second radiating element 120 that have different shapes than just a straight rectangular prism shape. For example, the first radiating element 110 and/or the second radiating element 120 may have bends or curvatures to better fit inside the mobile computing device or to better fit the components and/or the PCB of the mobile computing device. According to FIG. 1A, the first ground point 112 and the second ground point 122 are located on the PCB 140 on substantially two opposite ends. In other embodiments, the location of the grounds points may be positioned closer together. The location of the grounds points may influence the tuning of the frequencies of the radiating elements 110, 120 because the locations may vary the dimensions of the radiating elements 110, 120 (e.g., lengths).

Figure 1B:
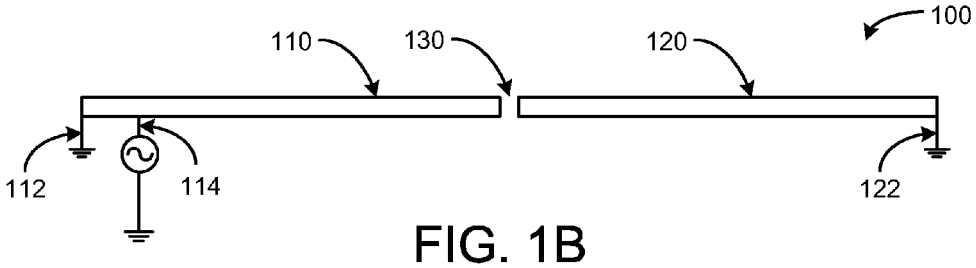
FIG. 1B illustrates a circuit diagram of the example antenna assembly of FIG. 1A.
Figure 1C:
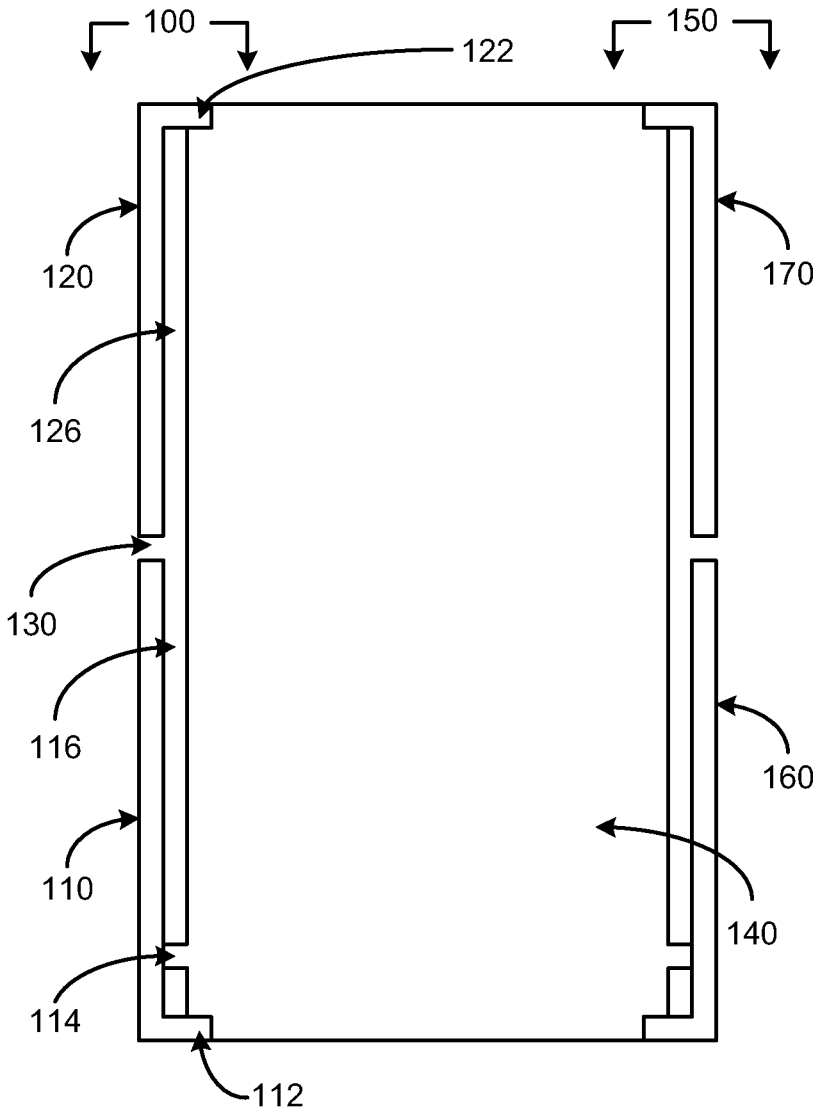
FIG. 1C illustrates an example antenna assembly for a computing device, under another embodiment.

FIG. 1B illustrates an example circuit diagram of the antenna assembly of FIG. 1A. As illustrated in FIG. 1B, the second radiating element 120 does not have a feed point, but is connected to the second ground point 122. The first radiating element 110 is connected to a feed point 114 (that is close to the end of the first radiating element that is coupled to the first ground point 112) that is coupled to a signal source. As discussed, the third gap 130 may be dimensioned to cause the second radiating element 120 to behave as a passive radiating element and to also resonate at a particular frequency (e.g., at a low band frequency).

FIG. 1C illustrates an example antenna assembly for a computing device, under another embodiment. According to FIG. 1C, the computing device has two antenna assemblies, a first antenna assembly 100 (such as described in FIG. 1A) and a second antenna assembly 150. In some embodiments, the first antenna assembly 100 is the same overall shape and design as the second antenna assembly 150. The second antenna assembly 150 includes a first radiating element 160 and a second radiating element 170. Each is connected to a ground point of the PCB 140. The first radiating element 160 of the second antenna assembly 150 is also coupled to a feed point. The second antenna assembly 150 may operate like the first antenna assembly 100. The antenna assembly described in FIG. 1C may meet requirements set by standards and/or carriers, such as LTE, which requires two antenna assemblies for a mobile computing device.

In other embodiments, variations may exist between the first antenna assembly 100 and the second antenna assembly 150 of the same mobile computing device. Depending on different requirements (due to component sizes, PCB layout, or design of the housing, etc.), the geometries of the four radiating elements 110, 120, 160, 170, the widths of the gaps, and/or the locations of the ground points and/or feed points may vary. For example, the second antenna assembly 150 may be configured to resonate at a different (e.g., higher or lower) frequency than the first antenna assembly 100. In other embodiments, the second antenna assembly 150 may have radiating elements 160, 170 that have bends or curvatures to accommodate different sizing or device requirements.

Figure 2:
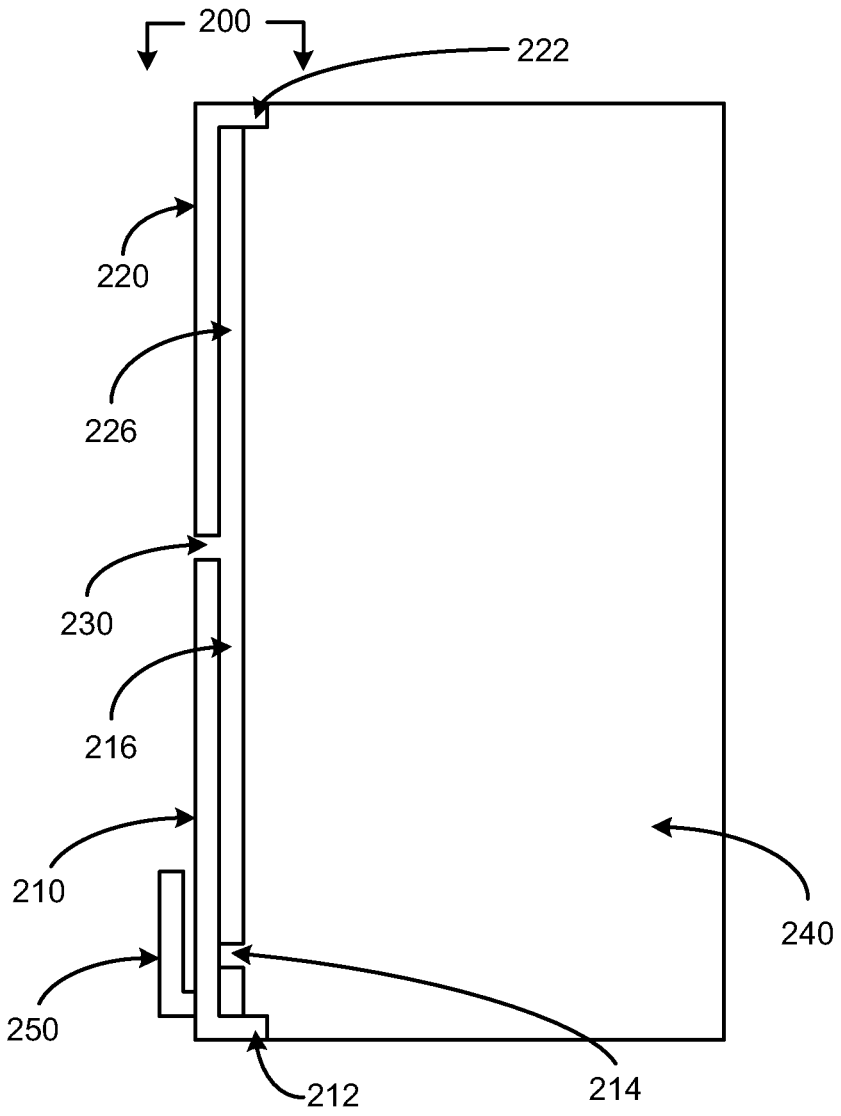
FIG. 2 illustrates an example antenna assembly for a computing device, under an embodiment.

FIG. 2 illustrates an example antenna assembly for a computing device, under another embodiment. In FIG. 2, the antenna assembly 200 includes three radiating elements. The first radiating element 210 is coupled to a first ground point 212 of the printed circuit board ("PCB") 240 and a feed point 214. The feed point 214 enables the first radiating element 210 to be coupled to a signal source (that is provided on or as part of the PCB 240) and in some embodiments, to other components (e.g., transceiver circuits, radio processing circuitry, processors) of a computing device. The second radiating element 220 is coupled to a second ground point 222 of the PCB 240.

In some embodiments, the first radiating element 210 is positioned adjacent to the PCB 240 so as to form a first gap 216 that extends between the first radiating element 210 and the PCB 240 along at least a portion of the length of the first radiating element 210. Similarly, the second radiating element 220 is positioned adjacent to the PCB 240 so as to form a second gap 226 that extends between the second radiating element 220 and the PCB 240 along at least a portion of the length of the second radiating element 220. The first radiating element 210 and the second radiating element 220 is also separated or spaced apart from each other by a third gap 230. The first radiating element 210 and the second radiating element 220 operate in a similar fashion as the radiating elements described in FIGS. 1A-1C. Depending on the geometries of the first and second radiating elements 210, 220, the first radiating element 210 may be tuned to resonate at a low frequency band (e.g., between 700-960 MHz), and the second radiating element 220 may behave as a passive radiating element and also resonate at a low frequency that is substantially the same frequency as the resonating frequency of the first radiating element 210.

The antenna assembly 200 includes a third radiating element 250. The third radiating element 250 is also coupled to the first ground point 212 and the first feed point 214. In one embodiment, the third radiating element 250 may have a geometry that is different from the first and second radiating elements 210, 220 so that the third radiating element 250 resonates at a higher frequency or frequency band (e.g., may have a shorter length or a different shape). The third radiating element 250 may resonate at, for example, a high frequency band of 1700-2200 MHz. By incorporating a third radiating element 250 in the antenna assembly 200, the antenna assembly 200 may operate in both a low frequency band and a high frequency band, thereby complying with carrier standards and/or requirements.

In another embodiment, the mobile computing device may include two antenna assemblies described in FIG. 2. Another antenna assembly 200 may be provided on the other side of the PCB 240 (e.g., similar to FIG. 1C) so that there are a total of six radiating elements. In other embodiments, the antenna assembly 200 may be provided on one side of the PCB 240 and another different antenna assembly (such as described in FIGS. 1A-1C and FIGS. 3A-4D below) may be provided on the other side of the PCB. The antenna assemblies may vary according to carrier standards and/or requirements.

Figure 3A:
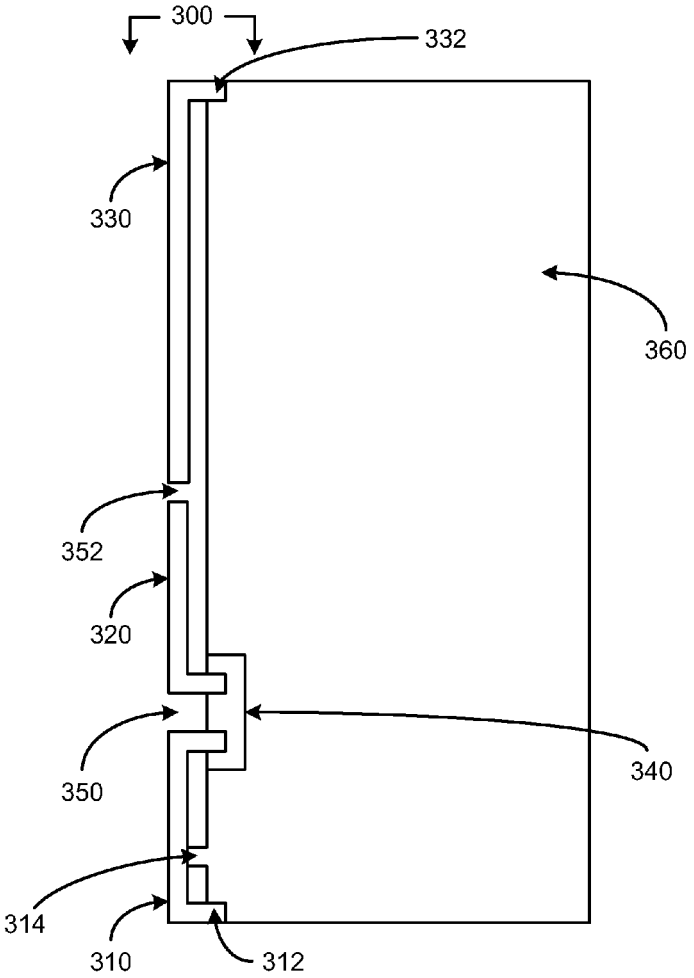
FIG. 3A illustrates an example antenna assembly for a computing device, under another embodiment.

FIG. 3A illustrates an example antenna assembly for a computing device, under another embodiment. The antenna assembly 300 described in FIG. 3A may operate in both a low frequency band and a high frequency band. The antenna assembly 300 includes a first radiating element 310, a second radiating element 320 and a third radiating element 330. The first radiating element 310 has a first end that is coupled to a first ground point 312 of the PCB 360 and a feed point 314, and a second end that is coupled to a circuit 340. In one embodiment, the circuit 340 is a selective circuit, such as a passive circuit (e.g., filter circuit), an active device, or a MEM device (e.g., switch). The circuit 340 operates with the antenna assembly 300 in order to enable the antenna assembly 300 to operate in both a low frequency and high frequency band (e.g., 700-960 MHz and 1700-2200 MHz, respectively).

In some embodiments, the circuit 340 is placed on the PCB 340 (as shown in FIG. 3A) with the second end of the first radiating element 310 being bent to connect to the circuit 340 and a first end of the second radiating element 320 also being bent to connect to the circuit 340. In another embodiment, the circuit 340 may be on the antenna assembly 300 itself, between the first and second radiating elements 310, 320. This is possible when the antenna structure is a printed conductor on a flexible PCB.

The second radiating element 320 has a first end that is coupled to the circuit 340 and a second end that is free (e.g., not coupled to the PCB 360). The third radiating element 330 is coupled to a second ground point 332 of the PCB 360. Similar to the antenna assemblies described above, each of the radiating elements 310, 320, 330 are spaced apart from the PCB 360 by gaps that extend along at least a length of each radiating element 310, 320, 330. Each of the radiating elements 310, 320, 330 is also spaced apart from each other by a first gap 350 and a second gap 352.

The circuit 340 enables the antenna assembly 300 to resonate at a first frequency (or frequency bands) and at a second frequency (or frequency bands). In some embodiments, the circuit 340 is a resonant and anti-resonant circuit that is resonant at a certain frequency band and anti-resonant at another frequency band. For example, when a signal is driven from a signal source (that is coupled to the feed point 314) to the first radiating element 310, for high frequencies the circuit 340 is resonant, and breaks the continuity between the first radiating element 310 and the second radiating element 320. This causes the first radiating element 310 to resonate at the high frequency band by itself. On the other hand, for low frequencies, the circuit 340 is anti-resonant, and causes a short between the first radiating element 310 and the second radiating element 320. This causes the first and second radiating elements 310, 320 to resonate together at the low frequency band. For illustrative purposes, for example, if the circuit 340 is represented as a switch, for high frequencies, it would be in an "open" state (thereby breaking the continuity between the first and second radiating elements 310, 320) and for low frequencies, it would be in a "closed" state (e.g., a short between the first and second radiating elements 310, 320 connecting them).

As discussed, in the high frequency band, the circuit 340 is resonant so that the first radiating element 310 resonates at a high frequency by itself. The first radiating element 310 may be dimensioned so that it can be tuned to resonate at a particular frequency or frequency band. In one embodiment, when the first radiating element 310 resonates by itself, the second radiating element 320 does not behave as a passive or parasitic radiating element because the second end is not coupled to a ground point of the PCB 360.

In the low frequency band, the circuit 340 is anti-resonant so that the first and second radiating elements 310, 320 resonate together at a certain low band frequency (e.g., in the 700-960 MHz band). For example, when the first and second radiating elements 310, 320 resonate together, they may behave like the first radiating element described in FIG. 1A. This causes the third radiating element 330 to behave as a parasitic or passive radiating element (due to the first and second radiating elements 310, 320 resonating together) and resonates at a substantially similar frequency (the frequencies may be 10 to 150 MHz different, for example). At the low frequency band, as the first and second radiating elements 310, 320 resonate together thereby causing the third radiating element 330 to also resonate (behaving as a passive radiating element), the frequency bandwidth of the antenna assembly 300 may be improved. As discussed above, the geometries of each of the radiating elements and the size (e.g., width) of the second gap 352 may be adjusted or configured to obtain the desired resonating frequencies for the antenna assembly 300.

Due to the duality of behaviors or responses of the circuit 340, the antenna assembly 300 may operate in the low frequency band and the high frequency band simultaneously. This is illustrated in FIG. 3C, explained below. According to an embodiment, the circuit 340 may be a passive filter. In some embodiments, the circuit 340 may comprise a tank circuit that includes a first capacitor and an inductor in parallel, and the inductor and a second capacitor in series (e.g., 0.5 pF, 12 nH, 2.4 pF, respectively).

In some embodiments, the first radiating element 310 and the second radiating element 320 may be substantially the same length (and/or the same width, thickness, etc.). The length of the third radiating element 330 may be substantially equal to the lengths of the first and second radiating elements 310, 320 and the width of the first gap 350 combined. This enables the side-by-side resonances in the low band frequencies. Depending on the desired frequencies of the antenna assembly 300 in the low frequencies and the high frequencies, the geometries of each of the radiating elements 310, 320, 330 and the widths of the gaps 350, 352 may be dimensioned so that the antenna assembly 300 is tuned to the desired frequencies.

Figure 3B:
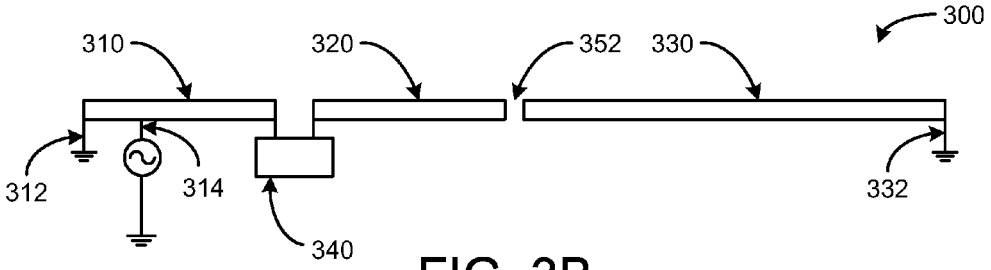
FIG. 3B illustrates a circuit diagram of the example antenna assembly of FIG. 3A.
Figure 3C:
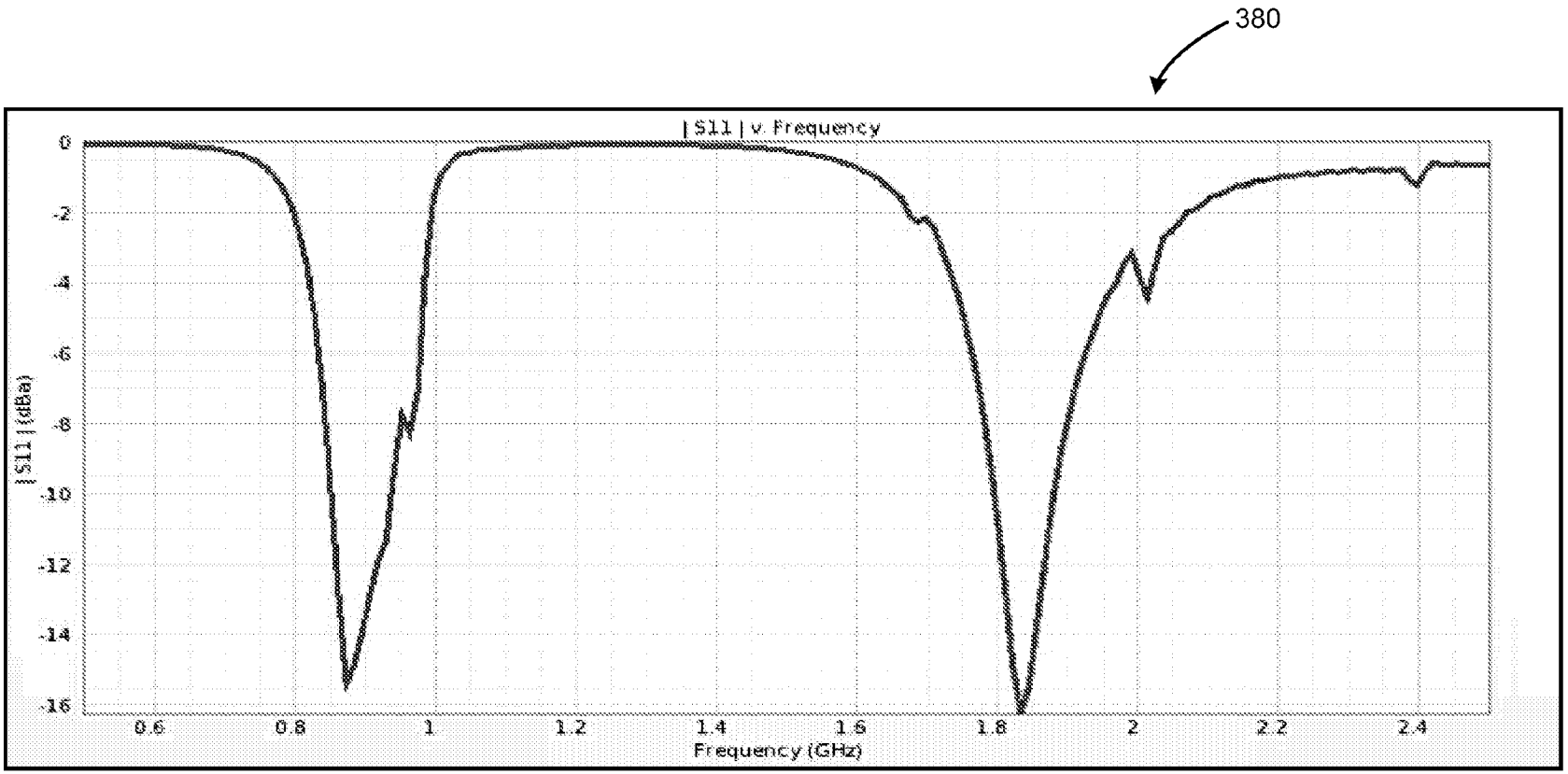
FIG. 3C illustrates a demonstrative frequency vs. return loss graph of an operation of the antenna assembly of FIG. 3A.

FIG. 3B illustrates a circuit diagram of the antenna assembly of FIG. 3A. As illustrated in FIG. 3B, there is one feed point 314 that is coupled to the first radiating element 310. The first radiating element 310 is also coupled to the first ground point 312 at or near the first end of the first radiating element 310. The second end of the first radiating element 310 is coupled to the circuit 340. The first end of the second radiating element 320 is coupled to the circuit 340 and the circuit 340 enables the first and second radiating elements 310, 320 to resonate in low frequencies and enable the first radiating element 310 to resonate by itself in high frequencies. The third radiating element 330 is coupled to the second ground point 332.

FIG. 3C illustrates a demonstrative frequency vs. return loss graph of an operation of the antenna assembly of FIG. 3A. Graph 380 illustrates two frequency bands, a low band and a high band, which represents the operating frequencies of the antenna assembly of FIG. 3A. In graph 380, the low frequency band is illustrated to be between approximately 800 MHz and 1000 MHz, while the high frequency band is illustrated to be between approximately 1700 MHz and 2100 MHz. As discussed, the antenna assembly 300 may be tuned to operate at particular frequencies to meet desired wireless communication standards and carrier standards.

In an alternate embodiment, the circuit 340 may be a two state switch, so that the antenna assembly 300 may operate in a first state (e.g., low frequency state) and a second state (e.g., high frequency state) interchangeably (e.g., not simultaneously). Variations for operating individually at different frequencies may be preferred or necessary depending on carrier or communication standard requirements. The two state switch may also include a control line on the circuit 340 and the radiating elements.

Figure 4A:
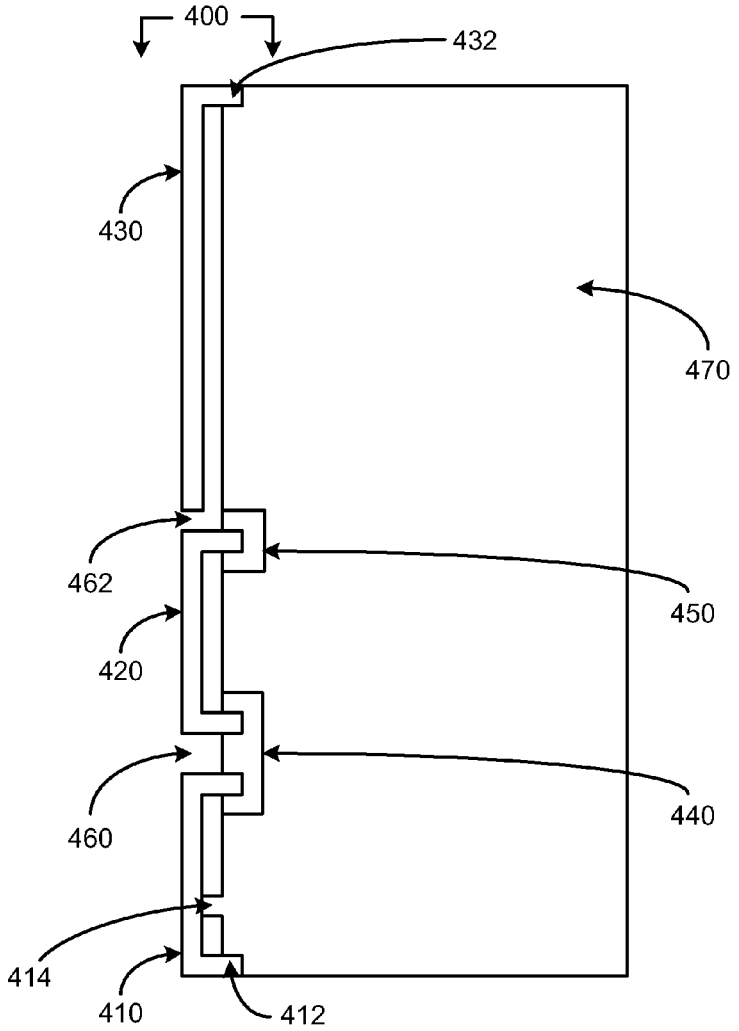
FIG. 4A illustrates an example antenna assembly for a computing device, under another embodiment.

FIG. 4A illustrates an example antenna assembly for a computing device, under another embodiment. The antenna assembly 400 differs from the antenna assembly 300 of FIG. 3A because it includes a second circuit 450. The antenna assembly 400 includes a first radiating element 410, a second radiating element 420 and a third radiating element 430. The first radiating element 410 has a first end that is coupled to a first ground point 412 of the PCB 470 and a feed point 414, and a second end that is coupled to a first circuit 440. According to an embodiment, the first circuit 440 is a selective circuit, such as a passive circuit (e.g., filter circuit), an active device, or a MEM device (e.g., switch). The first circuit 440 operates to enable the antenna assembly 400 to operate in both a low frequency and high frequency band (e.g., 700-960 MHz and 1700-2200 MHz, respectively).

In one embodiment, the second radiating element 420 has a first end that is coupled to the first circuit 440 and a second end that is coupled to the second circuit 450. The second circuit 450 may be a selective circuit, such as a passive circuit, an active device, or a MEM device (e.g., a two state switch). The first circuit 440 and/or the second circuit 450 may comprise a tank circuit that includes a first capacitor and an inductor in parallel, and the inductor and a second capacitor in series. The third radiating element 430 is coupled to a second ground point 432 of the PCB 470. Each of the radiating elements 410, 420, 430 is spaced apart from the PCB 470 by gaps that extend along at least a length of each radiating element 410, 420, 430. Each of the radiating elements 410, 420, 430 is also spaced apart from each other by a first gap 460 and a second gap 462.

The first circuit 440 and the second circuit 450 operate to enable the antenna assembly 400 to operate in multiple frequencies or frequency bands. In some embodiments, the first circuit 440 may be a resonant/anti-resonant circuit that is resonant at a certain frequency or frequency band (e.g., high frequency) and anti-resonant at another frequency or frequency band (e.g., low frequency). Similarly to the circuit 340 discussed previously with respect to the antenna assembly 300 in FIG. 3A, when a signal is driven from a signal source (that is coupled to the feed point 414) to the first radiating element 410, for high frequencies the first circuit 440 is resonant, and breaks the continuity between the first radiating element 410 and the second radiating element 420. This causes the first radiating element 410 to resonate at the high frequency band by itself.

However, in some embodiments, at the same time, for high frequencies, the second circuit 450 may operate to couple the second end of the second radiating element 420 to a third ground point of the PCB 470. As discussed, the second circuit 450 may operate in conjunction with the first circuit 440. In some embodiments, the second circuit 450 may also be a passive filter, such as a resonant/anti-resonant circuit or be a two state switch. In high frequencies, when the second radiating element 420 is coupled to the third ground point of the PCB 470 and when the first radiating element 410 resonates at the high frequency band by itself, the second radiating element 420 may behave as a passive or parasitic radiating element and resonates at a substantially similar frequency as the first radiating element 410 (e.g., the frequencies may be 10 to 150 MHz different). In this manner, the full potential bandwidth of the high frequency band may be realized because of the use of the passive or parasitic element of second radiating element 420.

Similarly, on the other hand, for low frequencies, the first circuit 440 is anti-resonant, and causes a short between the first radiating element 410 and the second radiating element 420. At the same time, the second circuit 450 operates to decouple the second end of the second radiating element 420 from the third ground point of the PCB 470. This causes the first and second radiating elements 410, 420 to resonate together at the low frequency band. The third radiating element 430 may then behave as a parasitic or passive radiating element (due to the first and second radiating elements 410, 420 resonating together) and resonates at a substantially similar frequency (e.g., the frequencies may be 10 to 150 MHz different). As the first and second radiating elements 410, 420 resonate together thereby causing the third radiating element 430 to also resonate (behaving as a passive radiating element), the frequency bandwidth of the antenna assembly 400 may be improved.

For example, for illustrative purposes, if the first and second circuits 440, 450 are represented as switches, for high frequencies, the first circuit 440 would be in an "open" state (thereby breaking the continuity between the first and second radiating elements 410, 420) and the second circuit 450 would be in a "closed" state (thereby coupling the second radiating element 420 to the third ground point of the PCB 470). For low frequencies, the first circuit 440 would be in a "closed" state (e.g., a short between the first and second radiating elements 410, 420 connecting them) and the second circuit 450 would be in an "open" state (thereby decoupling the second radiating element 420 from the third ground point).

According to an embodiment, the geometry of the radiating elements and the size of the gaps (e.g., width) may be dimensioned to achieve particular frequency or frequency band operations. For example, the first radiating element 410 may be dimensioned (e.g., have a particular thickness, length, width) so that it is tuned to resonate at a high frequency or high frequency band. In some embodiments, the first radiating element 410 and the second radiating element 420 may be substantially the same length (and/or the same width, thickness, etc.). The length or dimensions of the third radiating element 430 may be much longer than the lengths of the first and second radiating elements 410, 420. Depending on the desired frequencies of the antenna assembly 400 in the low frequencies and the high frequencies, the geometries of each of the radiating elements 410, 420, 430 and the widths of the gaps 460, 462 may be dimensioned so that the antenna assembly 400 is tuned to the desired frequencies.

In some embodiments, the second circuit 450 may be a resonant/anti-resonant circuit. In other embodiments, the second circuit 450 may be a different circuit from the first circuit 440 and/or may be a passive element, active device, or MEM device. Due to the duality of behaviors or responses of the first and second circuits 440, 450, the antenna assembly 400 may operate in both the low frequency band and the high frequency band simultaneously (e.g., when the first and second circuits 440, 450 are resonant/anti-resonant passive circuits).

Figure 4B:
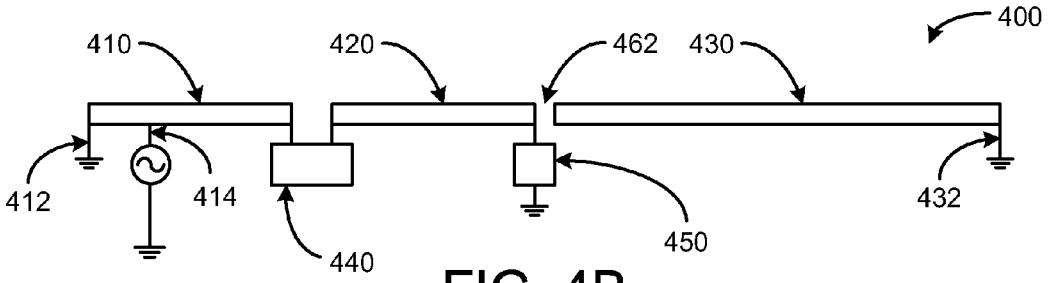
FIG. 4B illustrates a circuit diagram of the example antenna assembly of FIG. 4A.

FIG. 4B illustrates a circuit diagram of the example antenna assembly of FIG. 4A. As illustrated in FIG. 4B, there is one feed point 414 that is coupled to the first radiating element 410. The first radiating element 410 is also coupled to the first ground point 412 at or near the first end of the first radiating element 410. The second end of the first radiating element 410 is coupled to the first circuit 440. The first end of the second radiating element 420 is coupled to the first circuit 440 to enable the first circuit 440 to allow the first and second radiating elements 410, 420 to resonate together in low band frequencies and allow the first radiating element 410 to resonate by itself in high band frequencies. The second end of the second radiating element 420 is coupled to a second circuit 450. The second circuit 450 may enable the second radiating element 420 to couple to a third ground point of the PCB. The third radiating element 430 is coupled to the second ground point 432 to behave as a passive or parasitic radiating element when the first and second radiating elements 410, 420 resonate together in low frequencies.

Figure 4C:
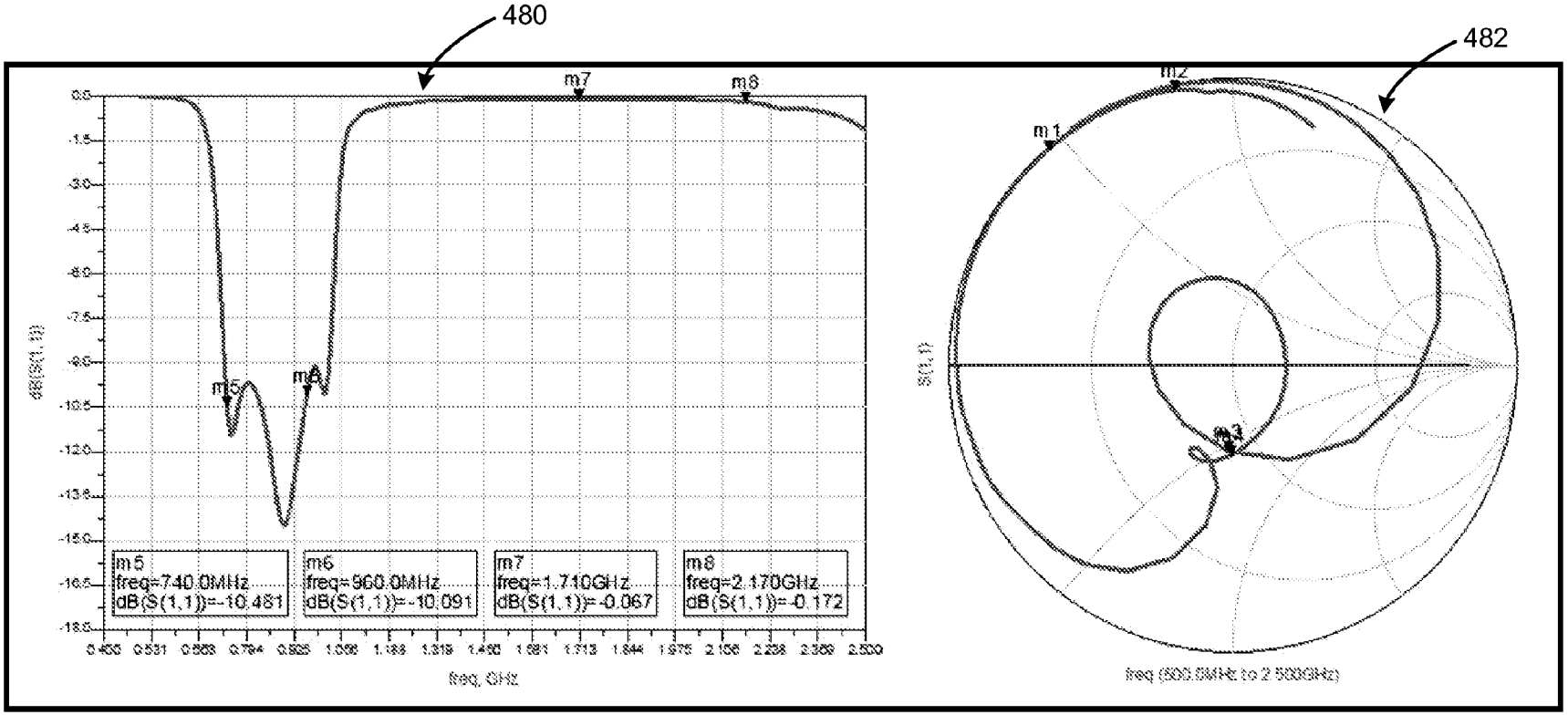
FIG. 4C illustrates a demonstrative frequency vs. return loss graph and Smith chart of an operation of the antenna assembly of FIG. 4A.

FIG. 4C illustrates a demonstrative frequency vs. return loss graph and Smith chart of an operation of the antenna assembly of FIG. 4A. Graph 480 illustrates a demonstration of the antenna assembly 400 in just the low frequency band operation (e.g., using ideal switches—open and short—for first and second circuits 440, 450). In low frequency band operations, the full bandwidth potential of low frequencies is achieved in the antenna assembly 400 of FIG. 4A. In graph 480, the low frequency band is illustrated to be between approximately 700 MHz and 1000 MHz, thereby covering a wide range of frequencies in the lower frequency operation. As discussed, the antenna assembly 400 may be tuned to operate at particular frequencies to meet desired wireless communication standards and carrier standards.

The Smith chart 482 illustrates the antenna impedance at different frequencies for the demonstration of the antenna assembly 400 in just the low frequency band operation (e.g., omitting the high frequency band operation portion on the graph for illustrative purposes). The Smith chart 482 illustrates that the antenna assembly 400 resonates best for low frequencies near the center of the Smith chart 482 (e.g., a VSWR circle, which is not currently shown in the chart, would encompass the smaller loop). The further out from the center of the circle illustrates poorer radiation of the antenna assembly 400 due to mismatch losses.

Figure 4D:
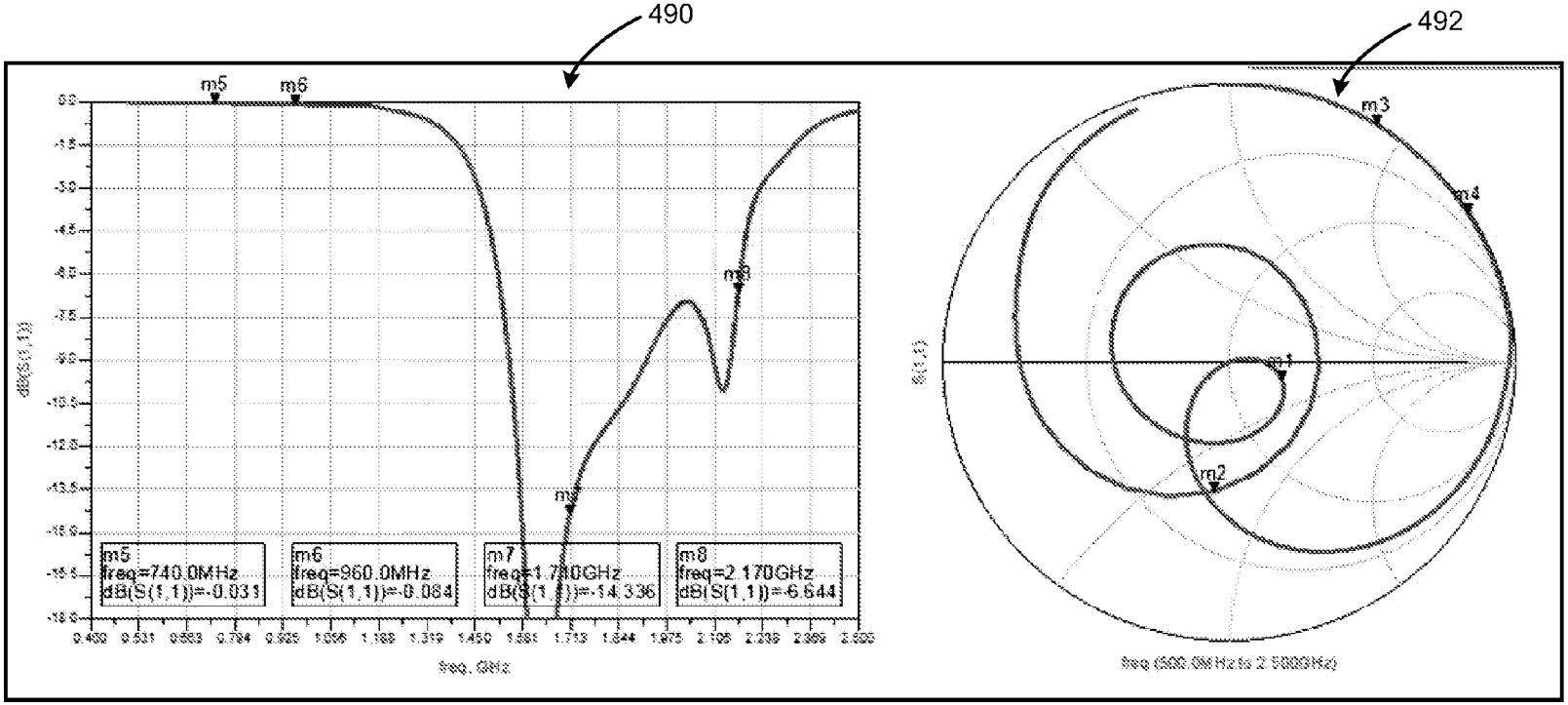
FIG. 4D illustrates a demonstrative frequency vs. return loss graph and Smith chart of another operation of the antenna assembly of FIG. 4A.

FIG. 4D illustrates a demonstrative frequency vs. return loss graph and Smith chart of another operation of the antenna assembly of FIG. 4A. Graph 490 illustrates a demonstration of the antenna assembly 400 in just the high frequency band operation (e.g., using ideal switches—open and short—for first and second circuits 440, 450). In high frequency band operations, the full bandwidth potential of high frequencies is achieved in the antenna assembly 400 of FIG. 4A. In graph 490, the high frequency band is illustrated to be between approximately 1500 MHz and 2200 MHz, thereby covering a wide range of frequencies. As discussed, the antenna assembly 400 may be tuned to operate at particular frequencies to meet desired wireless communication standards and carrier standards.

The Smith chart 492 illustrates the antenna impedance at different frequencies for the demonstration of the antenna assembly 400 in just the high frequency band operation (e.g., using ideal switches—open and short—for first and second circuits 440, 450). The Smith chart 492 illustrates that the antenna assembly 400 resonates best for high frequencies near the center of the Smith chart 492 (e.g., the VSWR circle, which is not currently shown in the chart, would encompass the two smaller loops). The further out from the center of the circle illustrates poorer radiation of the antenna assembly 400 at high frequencies due to mismatch losses.

As illustrated in the graphs 480, 490, the full potential of the bandwidths of both the low frequency band and the high frequency band is achieved (as compared to the antenna assembly in FIG. 3A below, for example). Compared to the graph 380 in FIG. 3C, the graphs 480, 490 encompass a broader range of frequencies. One advantage of the antenna assembly 400, as compared to the antenna assembly 300, may be a result of using a second circuit 450.

Hardware Diagram

Figure 5:
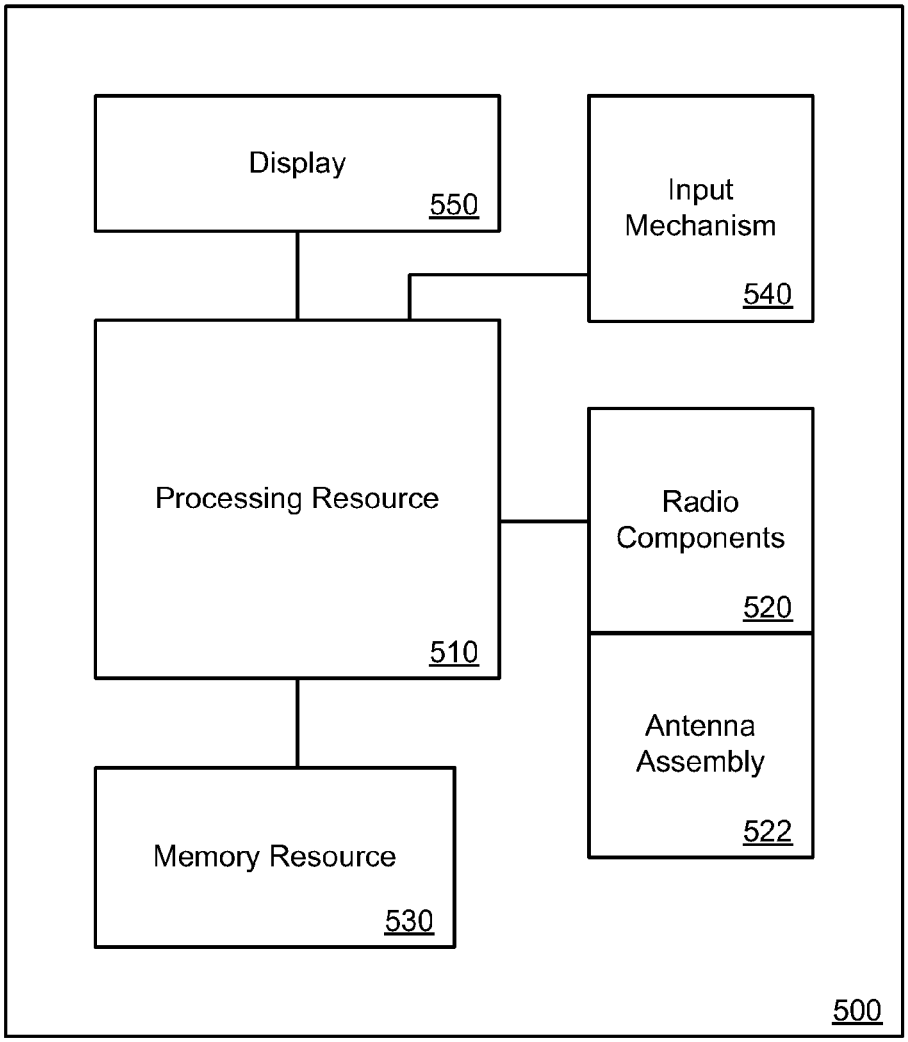
FIG. 5 illustrates a hardware diagram of an example computing device including an antenna assembly, according to one or more embodiments.

FIG. 5 illustrates an example hardware diagram of a computing device, according to one or more embodiments, upon which embodiments described herein may be implemented. For example, the antenna assemblies described above with respect to FIGS. 1A-4D, may be implemented with the computing device such as illustrated in FIG. 5.

In an embodiment, computing device 500 includes a processing resource 510, radio components 520, one or more antenna assemblies 522, memory resources 530, input mechanisms 540, and a display 550. The computing device 500 may also include a plurality of communication ports and/or other features (not shown in FIG. 5). The processing resource 510 is coupled to the memory resource 530 in order to process information stored in the memory resource 530, perform tasks and functions, and run programs for operating the computing device 500. The memory resource 530 may include a dynamic storage device, such as random access memory (RAM), and/or include read only memory (ROM), and/or include other memory such as a hard drive (magnetic disk or optical disk). Memory resource 530 may store temporary variables or other intermediate information during execution of instructions (and programs or applications) to be executed by the processing resource 510.

The computing device 500 may include a display 550, such as a cathode ray tube (CRT), a LCD monitor, an LED screen, a touch screen display, etc., for displaying information and/or user interfaces to a user. Input mechanism 540, including alphanumeric keyboards and other buttons (e.g., volume buttons, power buttons, and buttons for configuring settings), is coupled to computing device 500 for communicating information and command selections to the processing resource 510. Other non-limiting, illustrative examples of input mechanism 540 include a mouse, a trackball, a touchpad, a touch screen display, a keyboard (e.g., QWERTY format keyboard) or cursor direction keys for communicating direction information and command selections to the processing resource 510 and for controlling cursor movement on display 550. Embodiments may include any number of input mechanisms 540 coupled to computing device 500.

Computing device 500 also includes radio components 520 that are coupled to the antenna assembly 522 for communicating with other devices and/or networks (both wirelessly and/or through use of a wire). The radio components 520 may enable wireless network connectivity with a wireless router, for example, or for cellular telephony capabilities (e.g., when the computing device 500 is a cellular phone or tablet device with cellular capabilities). Radio components 520 may include communication ports for enabling IR, RF or Bluetooth communication capabilities, and may enable communication via different protocols (e.g., connectivity with other devices through use of the Wi-Fi protocol (e.g., IEEE 802.11 (b) or (g) standards), Bluetooth protocol, etc.). The antenna assembly 522 may be an antenna assembly described with respect to FIGS. 1A-4D.

Embodiments described herein are related to the use of the computing device 500 for implementing the techniques described herein. According to one embodiment, the techniques are performed by the computing device 500 in response to the processing resource 510 executing one or more sequences of one or more instructions contained in the memory resource 530. Such instructions may be read into memory resource 530 from another machine-readable medium, such as an external hard drive or USB storage device. Execution of the sequences of instructions contained in memory resource 530 causes the processing resource 510 to perform the process steps described herein. In alternative embodiments, hard-wired circuitry may be used in place of or in combination with software instructions to implement embodiments described herein. Thus, embodiments described are not limited to any specific combination of hardware circuitry and software.

Alternatives and Variations

Numerous alternatives and variations exist to embodiments described herein. A combination of different geometries and shapes of antenna elements, and a combination of different antenna assemblies may be incorporated into a computing device. For different embodiments of antenna assemblies, the geometries of the radiating elements and the size of the gaps may be dimensioned in order to properly tune and obtain desired frequencies and/or frequency bands.

Different combinations of antenna assemblies are possible for a computing device. For example, as illustrated in FIG. 2, two antenna assemblies are provided on each side of the PCB of a computing device. This may be useful for meeting LTE standards, for example, which require two antennas in a computing device. In other embodiments, a computing device may include two antenna assemblies described in FIG. 3A (antenna assembly 300), or two antenna assemblies described in FIG. 4A (antenna assembly 400), or may be a combination of different antenna assemblies on each side—e.g., both sides of the PCB do not have to include identical antenna assemblies; the antenna assembly 300 described in FIG. 3A may be on one side and the antenna assembly 400 described in FIG. 4A may be on the other side. A variety of different antenna assemblies with different geometries of radiating elements and/or gaps may be useful or desired depending on design of the layout of components on the PCB and/or depending on the spacing within a housing due to design of the housing of the device or size requirements. The variety of different antenna assemblies may also be desired for meeting specific wireless communication standards.

It is contemplated for embodiments described herein to extend to individual elements and concepts described herein, independently of other concepts, ideas or systems, as well as for embodiments to include combinations of elements recited anywhere in this application. Although illustrative embodiments of the invention have been described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mentioned of the particular feature. Thus, the absence of describing combinations should not preclude the inventor from claiming rights to such combinations.

What is claimed is:

1. An antenna assembly for a computing device, the antenna assembly comprising:

a first radiating element having a first end and a second end and being positioned along a first axis, the first end of the first radiating element being coupled to a feed point and a first ground point of a printed circuit board of the computing device, the first radiating element being positioned adjacent to an edge of the printed circuit board so as to form a first gap between the first radiating element and the edge of the printed circuit board along at least a portion of a length of the first radiating element;

a second radiating element having a first end and a second end and being positioned along the first axis, the second radiating element being positioned adjacent to the edge of the printed circuit board so as to form a second gap between the second radiating element and the edge of the printed circuit board along at least a portion of a length of the second radiating element;

a first circuit provided on the printed circuit board and coupled to the second end of the first radiating element and the first end of the second radiating element, the first circuit to enable the antenna assembly to resonate at either a first frequency or a second frequency; and a third radiating element having a first end and a second end and being positioned along the first axis, the first end of the third radiating element being free and the second end of the third radiating element being coupled to a second ground point of the printed circuit board, the third radiating element being positioned adjacent to the edge of the printed circuit board so as to form a third gap between the third radiating element and the edge of the printed circuit board along at least a portion of a length of the third radiating element.

2. The antenna assembly of claim 1, wherein the first circuit is resonant at the first frequency and anti-resonant at the second frequency.

3. The antenna assembly of claim 2, wherein the first radiating element and the second radiating element resonate together at the second frequency.

4. The antenna assembly of claim 1, wherein the third radiating element resonates at a third frequency in response to the first radiating element and the second radiating element resonating together at the second frequency, the third frequency being substantially equal to the second frequency.

5. The antenna assembly of claim 4, wherein (i) a size of a gap between the second end of the first radiating element and the first end of the second radiating element, (ii) a length of the first radiating element, and (iii) a length of the second radiating element are each dimensioned to enable the first radiating element and the second radiating element to resonate together at the second frequency.

6. The antenna assembly of claim 5, wherein a length of the third radiating element is substantially equal to a total length of (i) the length of the first radiating element, (ii) the length of the second radiating element, and (iii) the size of the gap between the second end of the first radiating element and the first end of the second radiating element.

7. The antenna assembly of claim 4, wherein a length of the third radiating element is dimensioned to enable the third radiating element to resonate at the third frequency.

8. The antenna assembly of claim 1, further comprising:

a second circuit provided on the printed circuit board and coupled to the second end of the second radiating element and a third ground point of the printed circuit board.

9. The antenna assembly of claim 8, wherein the second circuit connects the second end of the second radiating element to the third ground point when the first radiating element resonates at the first frequency, and wherein the second radiating element resonates at a fourth frequency in response to the first radiating element resonating at the first frequency, the fourth frequency being substantially equal to the first frequency.

10. A computing device comprising:

one or more processors;

one or more radio components coupled to the one or more processors;

a printed circuit board; and an antenna assembly, coupled to the one or more radio components and the printed circuit board, comprising:

a first radiating element having a first end and a second end and being positioned along a first axis, the first end of the first radiating element being coupled to a feed point and a first ground point of the printed circuit board, the first radiating element being positioned adjacent to an edge of the printed circuit board so as to form a first gap between the first radiating element and the edge of the printed circuit board along at least a portion of a length of the first radiating element;

a second radiating element having a first end and a second end and being positioned along the first axis, the second radiating element being positioned adjacent to the edge of the printed circuit board so as to form a second gap between the second radiating element and the edge of the printed circuit board along at least a portion of a length of the second radiating element;

a first circuit provided on the printed circuit board and coupled to the second end of the first radiating element and the first end of the second radiating element, the first circuit to enable the antenna assembly to resonate at either a first frequency or a second frequency; and a third radiating element having a first end and a second end and being positioned along the first axis, the first end of the third radiating element being free and the second end of the third radiating element being coupled to a second ground point of the printed circuit board, the third radiating element being positioned adjacent to the edge of the printed circuit board so as to form a third gap between the third radiating element and the edge of the printed circuit board along at least a portion of a length of the third radiating element.

11. The computing device of claim 10, wherein the first circuit is resonant at the first frequency and anti-resonant at the second frequency.

12. The computing device of claim 11, wherein the first radiating element and the second radiating element resonate together at the second frequency.

13. The computing device of claim 10, wherein the third radiating element resonates at a third frequency in response to the first radiating element and the second radiating element resonating together at the second frequency, the third frequency being substantially equal to the second frequency.

14. The computing device of claim 13, wherein (i) a size of a gap between the second end of the first radiating element and the first end of the second radiating element, (ii) a length of the first radiating element, and (iii) a length of the second radiating element are each dimensioned to enable the first radiating element and the second radiating element to resonate together at the second frequency.

15. The computing device of claim 14, wherein a length of the third radiating element is substantially equal to a total length of (i) the length of the first radiating element, (ii) the length of the second radiating element, and (iii) the size of the gap between the second end of the first radiating element and the first end of the second radiating element.

16. The computing device of claim 13, wherein a length of the third radiating element is dimensioned to enable the third radiating element to resonate at the third frequency.

17. The computing device of claim 10, wherein the antenna assembly further comprises a second circuit provided on the printed circuit board and coupled to the second end of the second radiating element and a third ground point of the printed circuit board.

18. The computing device of claim 17, wherein the second circuit connects the second end of the second radiating element to the third ground point when the first radiating element resonates at the first frequency.

19. The computing device of claim 18, wherein the second radiating element resonates at a fourth frequency in response to the first radiating element resonating at the first frequency, the fourth frequency being substantially equal to the first frequency.

20. An antenna assembly for a computing device, the antenna assembly comprising:

a first radiating element having a first end, a second end, and a length that extends along a first axis, the first end of the first radiating element being coupled to a feed point and a first ground point of a printed circuit board of the computing device, the first radiating element being positioned adjacent to an edge of the printed circuit board so as to form a first gap between the first radiating element and the edge of the printed circuit board along at least a portion of the length of the first radiating element;

a second radiating element having a first end, a second end, and a length that extends along the first axis, the second end of the second radiating element being free, wherein the second radiating element is positioned adjacent to the edge of the printed circuit board so as to form a second gap between the second radiating element and the edge of the printed circuit board along at least a portion of the length of the second radiating element;

a first circuit provided on the printed circuit board and coupled to the second end of the first radiating element and the first end of the second radiating element, the first circuit to enable the antenna assembly to resonate at either a first frequency or a second frequency; and a third radiating element having a first end, a second end, and a length that extends along the first axis, the first end of the third radiating element being free and the second end of the third radiating element being coupled to a second ground point of the printed circuit board, the third radiating element being positioned adjacent to the edge of the printed circuit board so as to form a third gap between the third radiating element and the edge of the printed circuit board along at least a portion of the length of the third radiating element, wherein the length of the third radiating element is substantially equal to a total length of (i) the length of the first radiating element, (ii) the length of the second radiating element, and (iii) a size of the gap between the second end of the first radiating element and the first end of the second radiating element.

* * * * *